United States Patent [19]

Mertin et al.

[11] Patent Number: 4,815,775

[45] Date of Patent: Mar. 28, 1989

[54] POWER-ASSISTED LOCK FOR VEHICLES

[75] Inventors: Ralf Mertin, Herdecke; Klaus Claar, Sindelfingen; Jan Schilling, Gechingen; Jürgen Schrader, Stuttgart; Holger Seel; Helmut Staiger, both of Aidlingen; Artur Mangold, Sulz a. N.; Gerhard Zweigart, Aidlingen, all of Fed. Rep. of Germany

[73] Assignees: Lunke & Sohn GmbH; Daimler-Benz AG, both of Fed. Rep. of Germany

[21] Appl. No.: 105,352

[22] Filed: Oct. 7, 1987

[30] Foreign Application Priority Data

Oct. 10, 1986 [DE] Fed. Rep. of Germany ..... 8626871

[51] Int. Cl.[4] ..... E05C 3/26

[52] U.S. Cl. ..... 292/201; 292/216; 292/DIG. 5; 292/DIG. 14

[58] Field of Search ..... 292/201, 216, DIG. 5, 292/254, DIG. 14, 217, 221

[56] References Cited

U.S. PATENT DOCUMENTS 2,742,280 4/1956 Wilcox ..... 49/280
2,896,990 7/1959 Garvey ..... 292/201 X
4,643,470 2/1987 Kayuyuki et al. ..... 292/216

OTHER PUBLICATIONS

German Publication No. 1,428,551, published May 13,1964.

German Publication No. 8,322,896, published Mar. 22, 1984.

*Primary Examiner*—Richard E. Moore

*Attorney, Agent, or Firm*—Banner, Birch, McKie & Beckett

[57] ABSTRACT

The invention concerns a power-assisted lock for doors, hatches hoods or hard tops of vehicles and the like. In addition to a known pivotal latch and a catch for a releasable engagement with the pivotal latch there is a control disc pivotally mounted in the housing of the lock. A manual or power actuated drive means is attached to the control disc for the closing and opening operation. The pivotal latch and the control disc have a drive connection providing for limited play. The arrangement together with the catch leads to a locking of the control disc before a closing operation and an unlocking of the control disc by turning the pivotal latch during the closing operation of the lock. The pivotal latch has the usual pre-lock position.

13 Claims, 3 Drawing Sheets

POWER-ASSISTED LOCK FOR VEHICLES

BACKGROUND OF THE INVENTION

The lock comprises a pivotal latch which cooperates with the lock bolt, a catch which releasably holds the pivotal latch, and a power member for the pivotal latch. Locks of this nature are preferably used on heavy doors and trunk lids, for example, where considerable forces are involved if the door or trunk lid is thrown shut. They are also used for doors that are not sufficiently stable to maintain alignment between the door or trunk lid and the lock, in which case as the door or trunk lid approaches its closed position, the actual closing is accomplished by the lock. On vans and light trucks, for example, the locks are positioned in general at bumper level and the door or trunk lid is apt to be pushed closed at a point that is not directly in line with the lock bolt, which can cause distortion and thus incorrect alignment of the lock bolt and the lock.

When power-assisted locks are used it is necessary only to bring the lock bolt close to the lock in order to activate the power member which then completes closing of the door or trunk lid or hood and provides a locking action. Opening the lock can be achieved by reversing the power member or manually with the aid of a hand lever either close to or remote from the lock. The known embodiments of power-assisted locks are rather complex and have a multitude of joints and links so that the manufacturing cost are considerable, and are subject to malfunctioning.

It is an object of this invention to provide a power-assisted lock having a very small number of parts.

It is a further object of the invention to provide a relatively small lock that can be installed, for example, in a window frame of a convertible automobile without difficulty.

It is a further object of the invention to create a power-assisted lock which is extremely reliable.

SUMMARY OF THE INVENTION

In addition to a pivotal latch, the invention proposes to use a pivotally mounted control disc having a stop for a catch in the unlocked position of the lock and a slope for camming the catch from the stop position into a retracted position. The pivotal latch also has a stop effective when the pivotal latch is turned in the opposite direction, a slope having the same function as the slope on the catch, and a power member, especially a hydraulic cylinder, connected to the control disc. The control disc is connected to the pivotal latch through a connection that provides for play so that, during a closing operation, pivotal movement of the pivotal latch by the lock bolt unlocks the control disc and, during the opening operation, pivotal movement of the control disc unlocks the pivotal latch—pivotal movement of the control disc being either through reverse movement of the power member or manually.

The power-assisted lock according to the invention has, in addition to a pivotal latch similar to known latches, a "counter-latch", namely the control disc which in the open position of the lock acts to stop or restrain the power member. The design includes a catch with two stop surfaces arranged back-to-back to provide a locking action in opposite directions. In this way the power member may be actuated and under tension without effect when the lock is open. Only after the lock bolt has turned the pivotal latch an amount sufficient for the unlocking slope on the pivotal latch to unlock the control disc and thus the power-member, is the latter able to move, i.e. to effect a closing movement of the lock. The lock bolt is so far inserted into the lock at this time that it is securely gripped and pulled into the final locked position.

Because of the characteristics of the lock according to the invention, almost any power member may be used which is capable of pulling the lock home after the lock bolt is initially inserted. Springs, pneumatic cylinders, hydraulic cylinders, electrically driven worm gear units or weights may be used—in the latter case the force being generated by gravity. It is important only that the closing movement of the power-member be reversible either in a driven fashion or manually with the aid of a hand-lever or the like.

A condition for reliable functioning is the advance movement of the pivotal latch relative to the control disc during the closing operation and the advance movement of the control disc relative to the pivotal latch during the opening operation in the reverse direction. The advance movement is accomplished by a drive connection having considerable play such as by a pin for instance mounted on the control disc and extending through an oblong hole in the pivotal latch. A spring can be inserted between the pivotal latch and the control disc to take up the play. For reasons of stability and to facilitate assemble, the pivotal latch and the control disc are mounted on a single bolt. When the control disc is keyed to the bolt for rotation, the bolt may be used for rotating the control disc for instance by a shaped recess into which a key or hand-lever may be inserted. In other cases a crank or a remote control mechanism may be permanently installed.

The control disc is pivotally mounted and is adapted to be moved angularly by the power-member during the closing and opening operations. Angular movements of approximately 90° are sufficient and can be generated conveniently by a link or connecting rod pivotally connected at one end to the control disc and at the other end is guided along a straight path, as by a slot disposed remote from the bolt carrying the pivotal latch and the control disc. A hydraulic cylinder can be connected to the end of the link that is guided in the slot. In some designs, of course, the power-member can be connected directly to the control disc. In a preferred design, the pin for the drive connection between the pivotal latch and the control disc which provides for play is also the journal for a link for the power member. If the frame of the lock consist of two lateral wall sections, a double link is preferred.

The catch can be guided in slots in the frame or can be pivotally mounted in the frame and, in the latter case, may have an angular, comma-like shape. In both cases a spring action is necessary to bias the catch into a stop position and to allow a resiliently-resisted movement into the retracted position. By retracted position is meant a position of the catch in which a stop on the control disc or on the pivotal latch can pass the catch by rotation out of the stop position.

It is common practice to provide a pre-closing on door or trunk lid locks in which a corresponding door or lid is not yet closed but in which the lock has already started to function. This characteristic is also obtainable with the lock according to this invention by providing the pivotal latch with an auxiliary stop and the control disc with an auxiliary slope. Opening the lock follows the same operations as described herein before so that the operations are repeated in sequence. For unlatching the pivotal latch from the pre-closing position it is also necessary to have an advance movement of the control disc during the opening operation.

A power-assisted lock according to the invention cannot only be used for closing soft convertible tops against the frame of the windshield or for lids which cover the folded tops, but it's also usable for securing so-called hard tops, i.e. solid roofs which may be placed onto the body of a convertible automobile during the winter months in place of the soft top. Depending on the size and the material and equipment, and also depending on the stability of the hard tops, the weight can be rather high and two people are required to handle it. In placing a hard top of the car it is therefore especially difficult to locate each of the lock bolts in the corresponding lock entrances. Under these circumstances it is preferred that the locks for securing a hard top allow for inserting of the lock bolts but do not allow the bolts to seat in the locks until a separate operation is performed, for instance, activating the power member. In a further development of the invention, a pivotal latch of each lock—there can be up to four locks for a hard top—is provided with a further stop in addition to the additional stop and the auxiliary stop, which further stop is positioned in such a way relative to the unlocking slope that, in the stop position, the control disc is already unlocked. Turning the control disc thus releases the stop.

In this modification, each of the lock bolts of the hard top are prevented from seating differently in their respective locks. Instead, each lock bolt is supported at the same level when the pivotal latch has reached its stop position. The hard top is thus pre-positioned. Compared to the function described herein before, only a part of the function takes place automatically: the control disc is unlatched by this pre-positioning but the pivotal latch, however, is prevented from further turning in the closing direction.

This version of the lock according to the invention is suitable in connection with power members which can be positively activated, for instance by pneumatic cylinders, hydraulic cylinders or electrically driven worm gears since the power members can only be activated when all of the lock bolts have reached the same prepositioning level.

The modified version may also be used in the initially described lock in which the power members are activated from the outset and operation of the lock occurs immediately upon inserting the lock bolt into the pivotal latch. The difference is only that in the one version of the power-member is activated when the lock bolt reaches the pre-positioning level. Rapid closing with the pre-activated power members is suitable for use especially with hydraulically actuated soft tops.

For convenience hoods are opened and closed automatically or semi-automatically in the better equipped classes of autombiles. When the locks according to the invention having hydraulic cylinders as power members are used for securing soft tops to the upper portion of the windshield frame, it is sufficient to actuate all of the hydraulic cylinders, including those for the locks at the upper portion of the windshield frame. Due to the locking of the control disc, all of the hydraulic cylinders are locked against motion even if actuated. When the lock bolts engage the pivotal latches at the end of the soft top's closing operation, the hydraulic cylinders are unlatched and are then automatically actuated to close rapidly. Upon confirmation that the locks have been closed, such as by microswitches, a hydraulic system for the roof can be released from pressure since all of the locks are now mechanically stopped. The control equipment can be limited to one command, namely to actuate the complete hydraulic system once per opening or closing operation.

Constructed in this manner there is saved a considerable amount of hydraulic and electrical equipment which would otherwise be necessary for each of the operation steps and to translate them into corresponding hydraulic commands.

BRIEF DESCRIPTION OF THE DRAWINGS

Embodiments of the invention which are shown in the accompanying drawing are hereinafter described in greater detail. In the drawings.

DETAILED DESCRIPTION

Figure 1:
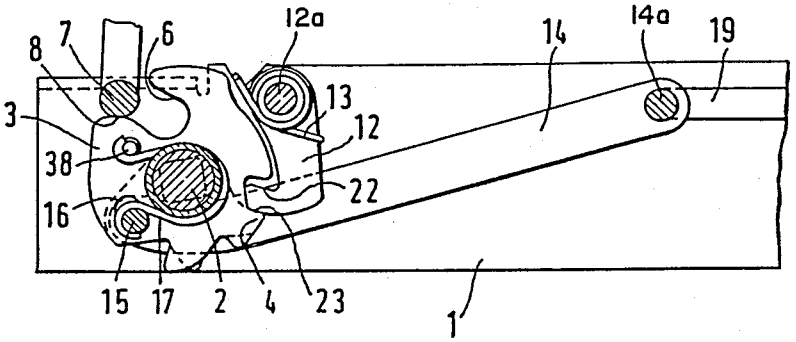
FIG. 1 is a vertical cross-sectional view through a power-assisted lock according to the invention.
Figure 2:
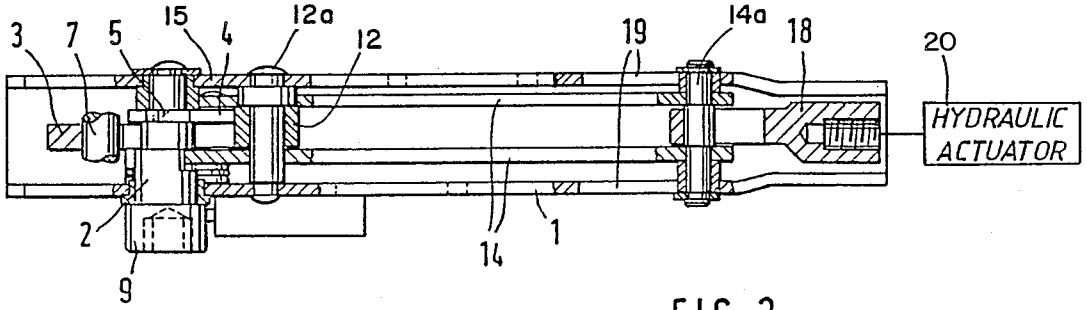
FIG. 2 is a horizontal cross-sectional view of the lock according to FIG. 1.

The lock according to invention shown in FIGS. 1 and 2 is mounted in a frame 1 comprising two juxtaposed walls joined in spaced parallel relation as by bolted or riveted spacers (not shown). A bolt 2 is mounted in the frame 1 for rotation in brass bushings and has mounted thereon a pivotal latch 3 and a control disc 4. While the pivotal latch 3 is free to oscillate on the bolt 2 the control disc 4 is keyed to the bolt 2 for rotation therewith by a square 5 formed on the bolt 2 that is received in a corresponding square hole 36 (FIG. 3) in the control disc 4.

The pivotal latch 3 has the usual mouth 6 for cooperation with the lock bolt 7 carried by the door or other closure member. At the opening of the mouth 6 there is the usual contact surface 8 which is pushed down during closing by the lock bolt 7 and thus rotates the pivotal latch 3 about the bolt 2. The bolt 2 is provided at one end with an allen head socket 9 (FIG. 2) adapted to receive an Allen wrench for manually turning the bolt 2 and, through the square 5, turning the control disc 4 about the axis of the bolt 2.

Adjacent the pivotal latch 3 and the control disc 4, there is a catch 12 pivotally mounted on a bolt **12*a*, the width of which catch is sufficient so that it will cooperate with both the pivotal latch 3 and the control disc 4. The catch 12 is biased into contact with the profile of the pivotal latch 3 and control disc 4, that is, in the clockwise direction as seen in FIG. 1, by a spring 13**.

Actuation of the lock is effected by the control disc 4 either manually by the Allen head socket 9 or by a link 14 comprising a pair of spaced link elements that are connected at one end by a pin **14*a* to a coupling 18 (FIG. 2) for connecting the same to a hydraulic or, for example, pneumatic cylinder 20. The other end of the link 14 is connected to the control disc 4 by a pin 15 which also extends through an oblong hole 16 in the pivotal latch 3. The pivotal latch 3** thus moves with the control disc 4 after the play between the pin 15 and the oblong hole 16 is taken up. A torsion spring 17 biases the pivotal latch 3 relative to the control disc 4 in a counter clockwise direction as seen in FIG. 1.

The pin 14*a* at the end of the double link 14 is slidably guided for linear movement in slots 19 in the frame 1 and is thus readily adapted to be connected to, for example, a hydraulic or pneumatic cylinder 20. With the bolt 14*a* in the left end of the slots 19 as seen in FIG. 1, the lock is in its opened position and, when at the right hand as seen in FIG. 2, is in its locked position.

Figure 3:
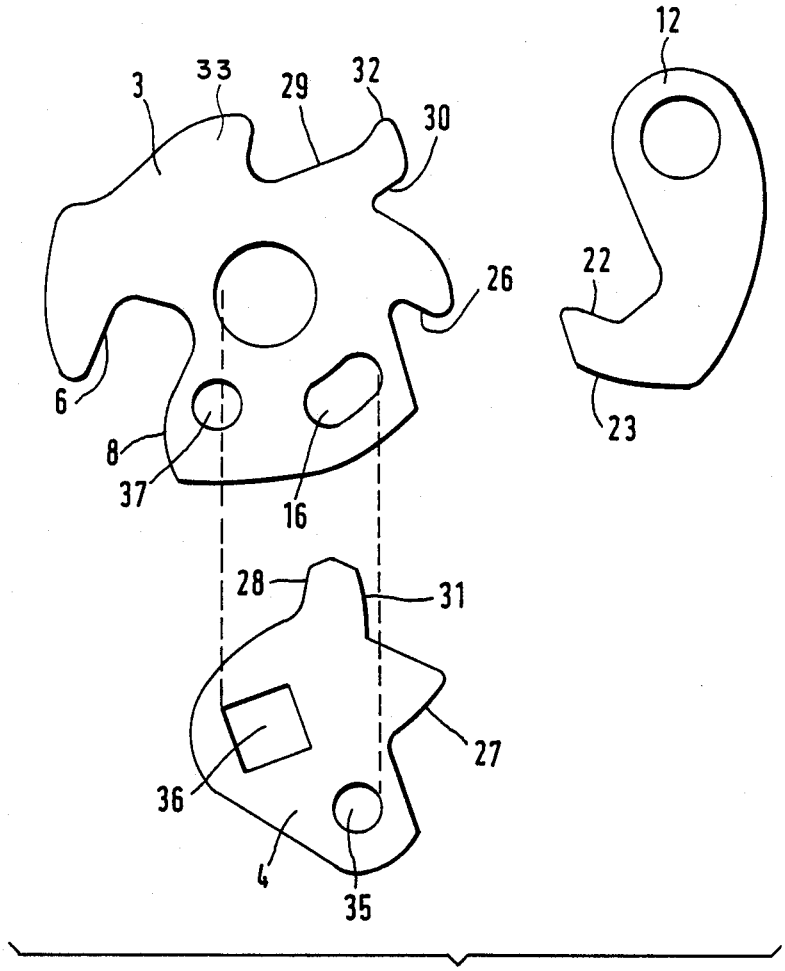
FIG. 3 is an exploded view of certain of the components of the lock according to the invention with a slightly modified pivotal latch.

The most important components of the lock according to the invention are the pivotal latch 3, the control disc 4 on the catch 12 which are shown separately in FIG. 3 to illustrate more clearly the details of their outer shapes. The interrelation of these components and the link 14 is shown sequentially in the different views of FIG. 4.

Opposite the mouth 6, the pivotal latch 3 has a stop 26 which cooperates with a stop surface 22 on the catch 12 in the locked position. The arrangement is such that upon pivotal movement of the catch 12 toward the pivotal latch 3, the stop 26 and the stop surface 22 meet. Immediately adjacent the stop 26 on the pivotal latch 3 is an auxiliary stop 30 which is also designed to cooperate with the stop surface 22 and serves as a pre-lock for the pivotal latch 3 before it goes into its final completely locked position.

Figure 4:
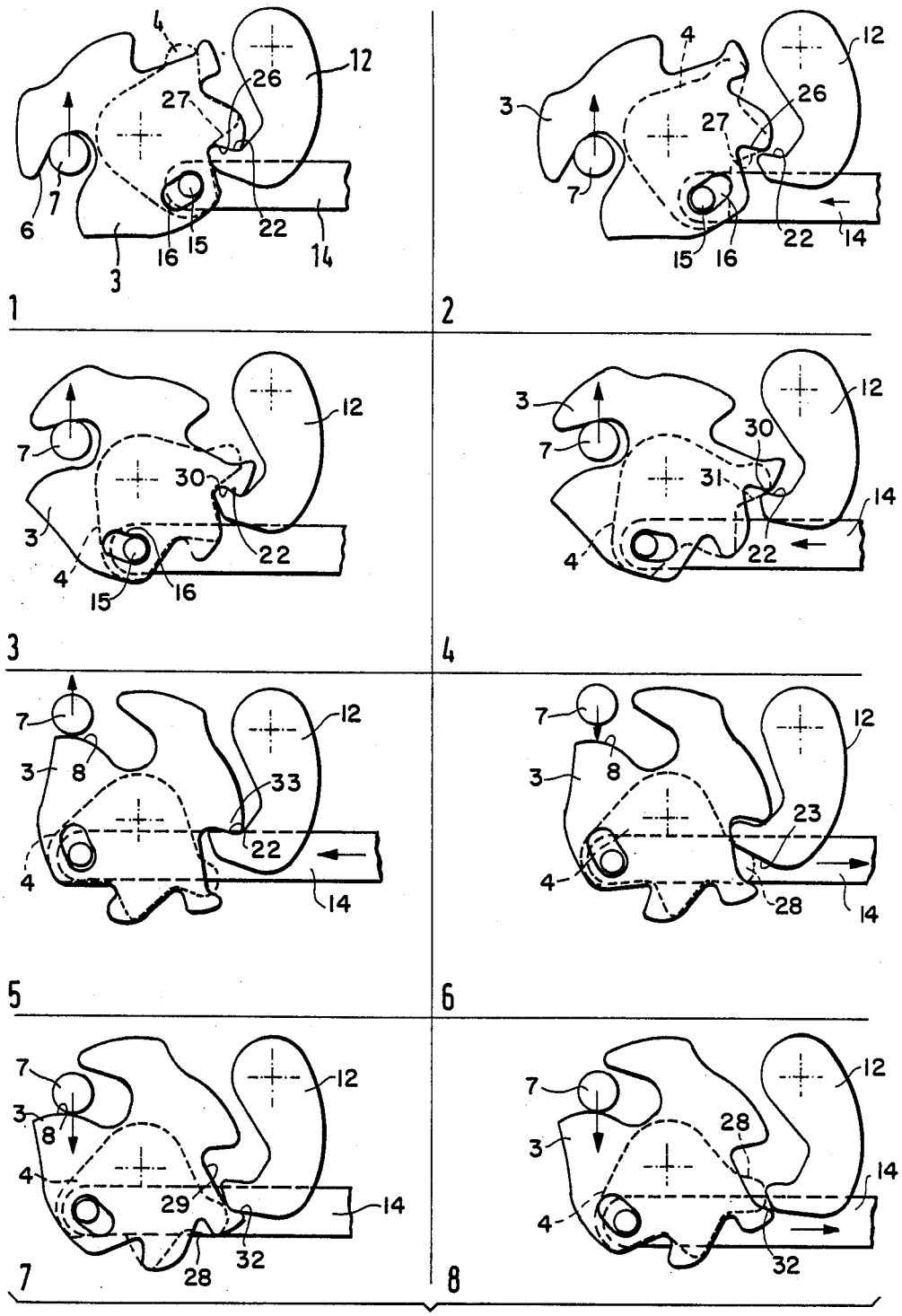
FIG. 4 is a series of eight sketches illustrating the successive steps in the operation of the lock according to the invention during opening and closing and identified respectively as FIG. 4–1 through FIGS. 4–8.

The control disc 4 also has a stop 28 which cooperates with a stop surface 23 at the bottom of the catch 12. The stop 28 is disposed relative to a cam surface or slope 29 on the pivotal latch 3 so that as the pivotal latch 3 turns, the slope 29 advances relative to the stationary control disc 4 to cam the catch 12 away from the stop 28 and thus release the stop 28 from the stop surface 23. When the play is taken up as the pivotal latch 3 advances—that is, when the pin 15 reaches the end of the oblong hole 16—the control disc 4 thereafter pivots with the pivotal latch 3 to move the stop 28 relative to the stop surface 23. A corresponding cam surface or slope 27 is formed on the control disc 4 which, upon movement of the control disc 4 relative to the catch 12, acts to pivot the catch 12 counter clockwise as seen in FIG. 4 to release the stop 26 from the stop surface 22. Finally, there is an auxiliary cam surface or slope 31 on the control disc 4 which releases the catch 12 from engagement with the auxiliary stop 30 upon relative movement between the control disc 4 and the catch 12.

Between the slope 29 and the auxiliary stop 30 of the pivotal latch 3 there is a stop surface 32 adapted to engage stop surface 23 of the catch 12 as the pivotal latch 3 is moved counterclockwise as seen in FIG. 4, that is, in the direction opposite to the direction which the stops 26 and 30 engage the stop surface 22.

The pivotal latch 3 has a further hole 37 which receives a pin 38 (FIG. 1) for anchoring one end of the spring 17. The other end of the spring 17 engages the pin 15 on the control disc 4.

The function and relative movements between the pivotal latch 3, the control disc 4 and the catch 12 during opening and closing is illustrated in FIG. 4. For clarity only a limited number of reference numerals have been used in the different views of FIG. 4 but the details of the elements will be evident upon reference to FIG. 3. Engaging surfaces in the different views of FIG. 4 have been emphasized by two opposed triangles.

The locked position of the lock is shown in FIG. 4–1. The pivotal latch 3 is shown in its extreme counterclockwise position in which the lock bolt 7 is securely seated in the mouth 6 and the stop 26 engages the stop surface 22 of the catch 12. To open the lock, the link 14 is moved to the left to rotate the control disc 4 or is manually turned clockwise until the pin 15 engages the opposite end of the oblong hole 16 in the now stationary pivotal latch 3 as seen in FIG. 4-2. During this movement the slope 27 of the control disc 4 urges the catch 12 out of engagement with the stop 26 of the pivotal latch 3. Because of the tension on the lock bolt 7 for instance by the door seals or by the spring tending to open the door, the pivotal latch 3 is now turned clockwise into the position shown in FIG. 4-3.

As the pivotal latch 3 thus turns, it moves relative to the control disc until the pin 15 is again seated in the right end of the oblong hole 16. The pivotal latch 3 and control disc 4 then turn together until the auxiliary stop 30 of the pivotal latch 3 engages the stop surface 22 of the catch 12.

Further turning of the control disc by the link 14 then advances the control disc clockwise relative to the pivotal latch 3 which, through the auxiliary slope 31 of the control disc 4, cams the catch 12 counterclockwise as seen in FIG. 4—4 to disengage the stop surface 22 of the latch 12 from the auxiliary stop 30. After the stop 30 is released the pivotal latch 3 is free to be moved into its opened position, as shown in FIG. 4-5. A second stop 33 on the pivotal latch 3 engages the stop surface 22 of the catch 12 to define the opened position of the pivotal latch 3. At this time, the contact surface 8 is in contact with the lock bolt 7 and the control disc 4 is again in its initial position relative to the pivotal latch 3, or in other words, the pin 15 on the control disc 4 is seated in the right end of the oblong hole 16 as shown in FIG. 4-5.

Reverse movement of the link 14 to turn the control disc counterclockwise as seen in FIG. 4-6 is prevented, by engagement of the stop 28 of the control disc 4 with the stop surface 23 of the catch 12, until the pivotal latch 3 is turned counterclockwise to release the stop arm 28. Counterclockwise movement of the pivotal latch 3 is effected during the closing operation by the lock bolt 7 which, as it's depressed, engages the contact surface 8 of the mouth 6. As the pivotal latch 3 turns, the slope 29 pushes the catch 12 out of engagement with the stop arm 28 of the control disc 4 until the control disc 4 is free to turn counterclockwise.

If there is no further turning of the control disc 4 either by the link 14 or manually, counter clockwise rotation of the pivotal latch 3 engages the stop 32 on the pivotal latch 3 with the stop surface 23 of the catch 12 as shown in FIG. 4-7. The control disc 4 is unlatched and the stop 32 is firmly held by the stop surface 23 of the catch 12. Thus, immediate seating of the lock bolt 7 in the mouth 6 is prevented, which has an advantage when several locks are to be actuated at the same time, for example in mounting a hard top on a convertible. By actuating all of the locks at the same time, they will all close simultaneously and thus avoid tilting and jamming that may otherwise result.

As shown in FIG. 4-7, play between the pivotal latch 3 and the control disc 4 is taken up as the pivotal latch 3 is advanced counterclockwise by the lock bolt 7. Because of the spring 17, the control disc 4 is biased counterclockwise relative to the pivotal latch 3 until the pin 15 is seated in the right end of the oblong hole 16. The spring 13 for the catch 12 is, however, much stronger than the spring 17 so the stop surface 23 of catch 12 remains in stop engagement with the stop 32 of the pivotal latch 3.

When the control disc 4 is turned counterclockwise manually or by the link 14, the stop 28 engages the catch 12 to cam it away from the stop 32 as shown in FIG. 4-8 to release the pivotal latch 3. The pivotal latch 3 is thus free to rotate and move sequentially in reverse through the positions shown in FIGS. 4—4, 4-3 and 4-2 to the position shown in FIG. 4-1, that is, from the pre-locking position to the fully locked position. During these operations the control disc 4 drives the pivotal latch 3 through the pin 15 since there is no locking effect during counterclockwise turning. Clockwise turning of the pivotal latch 3 is however prevented in the prelocking and the fully locked positions.

The three most important components of the lock according to the invention, that is, the pivotal latch 3, the control disc 4 and the catch 12, are preferably produced by punching and are hardened along the slopes and stop surfaces, all of which is well known. For mounting in more limited space, other configurations can be chosen so long as the function is retained. The catch 12 may be designed as a slider and the control disc 4 can be a toothed sector of a worm gear which cooperates with an electrically driven worm.

The stop 32 is only an optional feature of a lock according to the invention. During normal door operation in which the lock bolt 7 moves directly into the closing position solely upon movement of the door, the stop 32 causes interference and would be omitted as shown in FIG. 1 and 2.

The lock according to the invention has been described in connection with a vehicle. There are of course other suitable applications such as ships, buildings and other places having doors, flaps and other covers that are adapted to be closed by power-assist.

In the foregoing description of the lock according to the invention, the lock bolt 7 was mounted on a door, a hatch, a soft top or a hard top, and the frame 1 was situated at an appropriate place on the body of a vehicle. Of course, if desired, both components may be reversed that is, a lock bolt 7 can be attached to the body of the vehicle and the lock can be installed in the door, hatch or the like. A U-shaped member which is equivalent to a lock bolt may be substituted for the lock bolt and may have a more favorable attaching point to the panel.

We claim:

1. A power-assisted lock for doors, trunk lids, hoods or hard tops for vehicles or the like comprising a pivotally mounted pivotal latch having a mouth for cooperating with a lock bolt to impart pivotal movement to said pivotal latch, a catch cooperating with first and second stops of the pivotal latch for releasably stopping the pivotal latch in a pre-locked position and in a closed position, the pre-locked position being intermediate between an open and the closed position, a power member for imparting pivotal movement to said pivotal latch, a control disc mounted adjacent to and for pivotal movement relative to said pivotal latch and having a stop for engaging said catch to restrain the control disc against pivotal movement when the lock is in the open position, the second stop of said pivotal latch for engaging said catch to restrain said pivotal latch against pivotal movement when the lock is in the closed position, said control disc having a slope for camming the catch from the stop position determined by said second stop on said pivotal latch and said pivotal latch having a slope for camming said catch from the stop position determined by said stop on said control disc, and means for connecting said power member to said control disc and for connecting said control disc to said pivotal latch and providing for limited play between said control disc and said pivotal latch, whereby turning of said pivotal latch during a closing operation releases the control disc from its stop position and turning of said control disc during an opening operation releases said pivotal latch from its stop position.

2. A lock according to claim 1 wherein the power-member is a hydraulic cylinder.

3. A lock according to claim 1 wherein the pivotal latch and the control disc are pivotally mounted on a single pivot element.

4. A lock according to claim 3 wherein said means for connecting said control disc and said pivotal latch comprises a pin extending from a hole in the control disc through an oblong hole of the pivotal latch.

5. A lock according to claim 4 wherein said pin is mounted on said control disc and said means for connecting said power member to said control disc comprises a link connected at one end to said power member and journaled at its other end on said pin.

6. A lock according to claim 3 wherein said control disc is secured to said pivot element for pivotal movement therewith, and means for manually imparting pivotal movement to said pivot element and to said control disc.

7. A lock according to claim 1 having spring means acting between said pivotal latch and said control disc for biasing the same pivotally for taking up the play in one direction.

8. A lock according to claim 7 wherein said catch is pivotally mounted and resiliently biased in the direction toward the pivotal latch and the control disc.

9. A lock according to claim 8 wherein said spring biasing said catch is stronger than the spring between said pivotal latch and said control disc whereby said catch will take up the play between the pivotal latch and the control disc against the force of the spring between the pivotal latch and the control disc.

10. A lock according to claim 1 having a frame in which said lock is mounted.

11. A lock according to claim 5 having a frame in which said lock is mounted, the free end of said link being slidably guided in slots in said frame.

12. A lock according to claim 1 wherein said pivotal latch has an auxiliary stop for engaging said catch to restrain said pivotal latch against pivotal movement when the lock is in the pre-locking position and said control disc has an auxiliary slope for camming the catch from the stop position determined by said auxiliary stop.

13. A lock according to claim 12 wherein said pivotal latch has a second stop spaced from said auxiliary stop on the side opposite from the first stop for limiting turning of said pivotal latch during closing.

* * * * *